US008887615B2

(12) United States Patent
Kim et al.

(10) Patent No.: US 8,887,615 B2
(45) Date of Patent: Nov. 18, 2014

(54) FIREARM HAVING DUAL BARRELS

(75) Inventors: In Woo Kim, Daejeon (KR); Suk Kyun Hong, Daejeon (KR); Sung Bae Lee, Daejeon (KR); Eui Jung Choe, Daejeon (KR); Je Wook Chae, Daejeon (KR)

(73) Assignee: Agency for Defense Development, Daejon (KR)

( * ) Notice: Subject to any disclaimer, the term of this patent is extended or adjusted under 35 U.S.C. 154(b) by 223 days.

(21) Appl. No.: 13/229,495

(22) Filed: Sep. 9, 2011

(65) Prior Publication Data

US 2012/0233901 A1 Sep. 20, 2012

Related U.S. Application Data

(63) Continuation of application No. PCT/KR2010/002588, filed on Apr. 23, 2010.

(30) Foreign Application Priority Data

Apr. 24, 2009 (KR) ..... 10-2009-0035755

(51) Int. Cl.
*F42C 17/00* (2006.01)
*F41A 19/21* (2006.01)
*F41A 21/06* (2006.01)

(52) U.S. Cl.
CPC ..... *F41A 21/06* (2013.01); *F41A 19/21* (2013.01)
USPC ..... 89/6.5; 89/1.41; 89/127

(58) Field of Classification Search
USPC ..... 89/6, 6.5, 1.41; 42/105
See application file for complete search history.

(56) References Cited

U.S. PATENT DOCUMENTS

| | | | | | |
|---|---|---|---|---|---|
| 4,022,102 | A | * | 5/1977 | Ettel | 89/6.5 |
| 4,142,442 | A | * | 3/1979 | Tuten | 89/6.5 |
| 4,214,534 | A | * | 7/1980 | Richter et al. | 102/215 |
| 4,695,161 | A | * | 9/1987 | Reed | 356/254 |
| 5,272,514 | A | * | 12/1993 | Dor | 356/251 |
| 5,343,795 | A | * | 9/1994 | Ziemba et al. | 89/6.5 |
| 5,375,072 | A | * | 12/1994 | Cohen | 702/94 |
| 5,555,662 | A | | 9/1996 | Teetzel | |

(Continued)

FOREIGN PATENT DOCUMENTS

| | | | |
|---|---|---|---|
| KR | 10-0604343 | | 9/2006 |
| WO | WO 2006060489 | A2 * | 6/2006 |

OTHER PUBLICATIONS

International Search Report; dated Jan. 14, 2011.

*Primary Examiner* — Jonathan C Weber
(74) *Attorney, Agent, or Firm* — Kenneth E. Horton; Kirton McConkie

(57) ABSTRACT

Disclosed is a firearm having dual barrels comprising a firearm body which is equipped with a small caliber barrel and a large caliber barrel; a selector installed on one side of the firearm body to select the type of bullet and the mode of firing; a fire control system installed on the firearm body to enable aiming the target through detecting the target both at day and night time; a firearm switch unit installed on the firearm body to transmit the information on the firing of the bullet; a fuse setter installed on the firearm body to transmit the control signal of the fire control system to the fuse of the explosive bullet which is introduced into the large caliber barrel; and a sensor device unit installed on the firearm body to transmit the position of the selector and sensed firing signal to the fire control system.

7 Claims, 4 Drawing Sheets

(56) References Cited

U.S. PATENT DOCUMENTS

| | | | | |
|---|---|---|---|---|
| 5,628,137 | A * | 5/1997 | Cortese | 42/105 |
| 5,669,174 | A * | 9/1997 | Teetzel | 42/115 |
| 5,745,287 | A * | 4/1998 | Sauter | 359/428 |
| 5,831,718 | A * | 11/1998 | Desai et al. | 356/5.01 |
| 5,894,102 | A * | 4/1999 | Oberlin et al. | 89/6.5 |
| 5,942,714 | A * | 8/1999 | Oberlin et al. | 89/6.5 |
| 6,138,547 | A * | 10/2000 | Larsson et al. | 89/6.5 |
| 6,170,377 | B1 * | 1/2001 | Larsson et al. | 89/6.5 |
| 6,250,194 | B1 | 6/2001 | Brandl | |
| 7,021,187 | B1 | 4/2006 | Grassi | |
| 7,171,776 | B2 * | 2/2007 | Staley, III | 42/142 |
| 7,269,920 | B2 * | 9/2007 | Staley, III | 42/114 |
| 7,333,270 | B1 * | 2/2008 | Pochapsky et al. | 359/634 |
| 7,490,430 | B2 * | 2/2009 | Staley, III | 42/111 |
| 7,806,331 | B2 * | 10/2010 | Windauer et al. | 235/404 |
| 8,033,464 | B2 * | 10/2011 | Windauer et al. | 235/404 |
| 8,056,281 | B2 * | 11/2011 | Staley, III | 42/111 |
| 8,317,100 | B2 * | 11/2012 | Windauer et al. | 235/404 |
| 8,375,620 | B2 * | 2/2013 | Staley, III | 42/142 |
| 2006/0010761 | A1 * | 1/2006 | Staley, III | 42/142 |
| 2006/0048432 | A1 * | 3/2006 | Staley, III | 42/122 |
| 2009/0266892 | A1 * | 10/2009 | Windauer et al. | 235/404 |
| 2011/0162250 | A1 * | 7/2011 | Windauer et al. | 42/119 |
| 2012/0053878 | A1 * | 3/2012 | Windauer et al. | 702/94 |

* cited by examiner

FIREARM HAVING DUAL BARRELS

This application claims priority under 35 U.S.C. §371 of PCT Application No. PCT/KR2010/002588, filed on Apr. 23, 2010, which claims the benefit of Korean Patent Application No. 10-2009-0035755, filed on Apr. 24, 2009, the disclosures of which are incorporated herein by reference.

TECHNICAL FIELD

The present invention relates to a firearm having dual barrels by which regular bullets of small caliber and explosive bullets of large caliber can be selectively fired by using the same trigger, and more specifically, to a firearm having dual barrels wherein interfaces between the body of firearm and a fire control system, between the fire control system and the ammunition, and between the ammunition and the body of the firearm are all enabled so that the fire control system and the mode of explosion of the bullet can be controlled by the body of the firearm.

BACKGROUND ART

Conventional personal firearms use regular bullets without fuse and there is little need for fire control system as described later. The conventional personal firearms, however, have low firepower since small warheads are used in the weapons and the weapon can only attack the enemy through direct fire. It is also difficult to hit the target precisely since the distance to the target is usually measured through naked eye.

While other weapons such as a grenade launcher have been used to supplement the insufficient firepower of personal firearms, there have been problems of using a separate trigger other than the normal trigger of the weapon and it is also difficult to anticipate the precise timing of explosion since the grenade explodes after flying certain distance from the weapon. In other words, the body of the grenade rotates while flying thereby disarming the safety pin through centrifugal force, and the metal plate connected to the safety pin rotates to the ignition location and triggers the fuse. Therefore, it is difficult to know the timing of explosion unless the timing of operation of the fuse is directly controlled.

To solve these problems, some supplementary equipment have been attached to personal firearms such as a weapon sight or imaging equipment that can be used to correctly aim the target at night as well as during a day, and laser range finder for detecting exact distance to the target. These supplementary equipments, while having the effect of increasing the firepower of the weapon by improving precision in firing, provide little improvement on personal firearms which use regular bullets.

Meanwhile, research and development have recently been made on firearms having dual barrels that can selectively fire a regular bullet and an explosive bullet with one trigger. Explosive bullets are generally used to attack the target through fragments, and have the merit of being able to impact a large damage to the target compared to regular bullets, and can attack the enemy hiding behind a building or in a trench by controlling the bullets to explode above the target by using the information provided by the fire control system. Therefore, the firearms having dual barrels can greatly increase firepower of a user compared to conventional personal firearms which use regular bullets.

An important function of the fire control system is to display the reticle for aiming the target while firing, and the reticle needs to be moved by zeroing when considering error in the production and aiming error of an individual user. Also, some information should be input for efficient operation of the fire control system, and information input device is used for the position adjustment of the reticle and input of information.

The information input device is normally mounted on the case of the fire control system in the form of a switch, or attached to the fire control system forming an independent device separated from the fire control system. As the information input device is installed on the fire control system, the aiming state of the firearm should be reset to input information through the information input device.

Also, in order to maximize the firepower when using the explosive bullet, the mode of explosion should be set, for example, as "point detonation", "point delayed detonation" or "air bursting", which needs interface between the body of the firearm and the fire control system and the ammunition. In the above description, "point detonation" means that the explosive bullet is exploded as soon as the bullet reaches and contact the target, "point delayed detonation" means that the explosive bullet is exploded some delayed time after the bullet reaches the target, and "air bursting" means that the explosive bullet is exploded in the space just above the target.

DISCLOSURE OF INVENTION

Technical Problem

In the conventional firearms having dual barrels, however, this interface between the devices is impossible, thereby limiting the function of the weapon such as night shooting, precise aiming and air bursting. Also, it is difficult to take a prompt response to the changes in the state of the target since the state of aiming should be reset in order to control the mode of explosion of the bullet and to adjust the range.

The present invention has been designed to solve the problems of conventional firearms having dual barrels and to provide a firearm having dual barrels wherein interfaces between the body of firearm and the fire control system, between the fire control system and the ammunition, and between the ammunition and the body of the firearm are all enabled.

Another object of the present invention is to provide a firearm having dual barrels that can increase or decrease the range or can determine the mode of explosion of the explosive bullet through direct control of the fire control system and ammunition from the firearm body, thereby enabling prompt response to the change in the state of the target.

Solution to Problem

To achieve the object of the present invention, the firearm having dual barrels according to the present invention comprises a firearm body which is equipped with a small caliber barrel which fires small caliber regular bullet, and a large caliber barrel which fires explosive bullet, the regular bullet or explosive bullet being selectively fired through a trigger; a selector installed on one side of the firearm body to select the type of bullet and the mode of firing; a fire control system installed on the firearm body to enable aiming the target through detecting the target both at day and night time and to provide a firing data for explosive bullet by measuring the distance to the target; a firearm switch unit installed on the firearm body to transmit the information on the firing of the bullet which is additionally input by the user to the fire control system; a fuse setter installed on the large caliber barrel of the firearm body to transmit the control signal of the fire control system to the fuse of the explosive bullet which is inserted into the large caliber barrel; and a sensor device unit installed on the firearm body to transmit the position of the selector and sensed firing signal to the fire control system.

Further, in the firearm having dual barrels, the selector selects as the state value among an explosive bullet, single shot, burst shot and safe.

Further, in the firearm having dual barrels, the fire control system is equipped with a power switch which is connected to the power supply and introduces power to the daytime mode or night mode, a firearm connecting unit for the interface with the firearm body, a laser range finding unit for measuring the distance to the target, a thermal image sensor unit for detecting thermal image in the night mode, an image display unit which displays on the optical lens device the target distance acquired by the laser range finding unit and the thermal image detected by the thermal image sensor unit, a power distribution unit which supplies power to each units, and a ballistic trajectory calculation unit which calculates the bullet trajectory according to the target distance, and comprises a main control unit which controls each device according to the signal of the firearm body transmitted by the firearm connecting unit and transmits the control signal of the fuse of the explosive bullet to the fuse setter, and a menu selecting switch which enables selecting of the menus for controlling internal devices.

Further, in the firearm having dual barrels, the fire control system comprises a sensor unit comprising an inclination sensor detecting the inclination of the firearm body and a temperature sensor, and the main control unit changes the reticle displayed at the optical lens device according to the inclination of the firearm body and the temperature information.

Further, in the firearm having dual barrels, the firearm switch unit comprises a laser emitting switch installed on the fire control system for controlling the laser range finding unit, a range increment switch and range decrement switch for controlling the range to the value determined according to the detected range, and a fuse mode selection switch for determining the mode of explosion of the explosive bullet.

Further, in the firearm having dual barrels, the fuse setter transfers the energy required for the explosive operation of the fuse receiving unit of the explosive bullet in the way of non-contacting magnetic induction, and transmits the range information determined at the fire control system to the fuse receiving unit.

Further, in the firearm having dual barrels, the range information is input before the primer of the explosive bullet is fired by the firing pin in the large caliber barrel.

Finally, in the firearm having dual barrels, the sensor device unit comprises a selector position measuring unit for detecting the position of the selector and a firing signal sensing unit which generates a firing signal according to the movement of the trigger.

Advantageous Effects of Invention

The firearm having dual barrels of the present invention can selectively fire a regular bullet of small caliber and an explosive bullet of large caliber through one trigger, and the range and mode of explosion can be controlled on the firearm body in response to the change in the state of the target.

Also, by using the firearm having dual barrels of the present invention, it is possible to construct an interface between the firearm body and the fire control system, providing the effect of directly recognizing the type of bullet and firing mode determined by the selector of the firearm body, and responding according to the environment.

Also, it is possible to construct an interface between the firing control equipment and the bullet, providing the effect of precision fire of the explosive bullet and optimized energy consumption since proper amount of energy is supplied to the fuse of the bullet when the fuse mode of the explosive bullet is changed.

Finally, by using the firearm having dual barrels of the present invention, it is possible to construct an interface between the firearm body and the bullet, providing the effect of minimizing the necessary time to fire the explosive bullet since energy is supplied to the fuse when laser emitting switch is pressed and range information signal is transmitted to the fuse of the explosive bullet through the firing signal when trigger is pulled.

DESCRIPTION ON THE NUMERALS IN THE DRAWINGS

Figure 1:
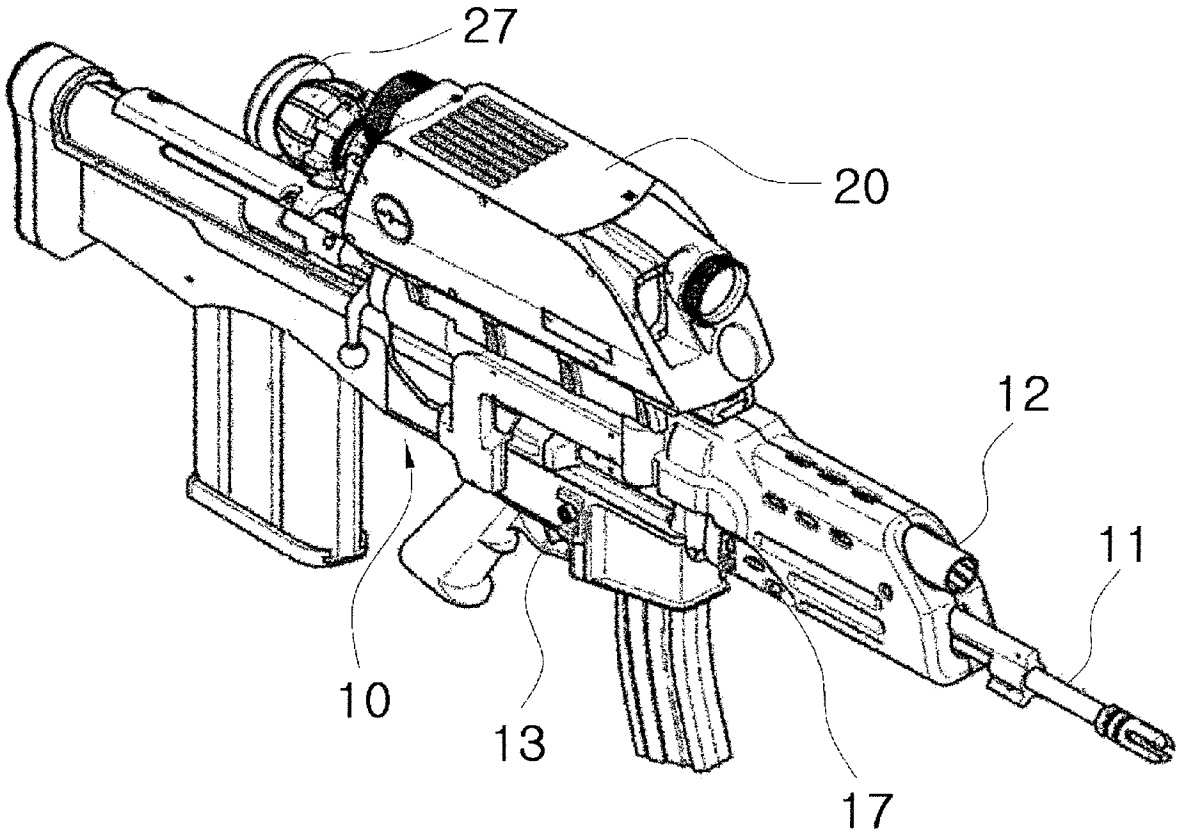
FIG. 1 is a perspective view from right of the firearm having dual barrels according to the present invention.

10: firearm body 11: small caliber barrel
12: large caliber barrel 13: trigger
15: selector 17: firearm switch
18: fuse setter 19: sensor device unit
20: fire control system 21: power switch
22: laser range finding unit 23: thermal image sensor unit
24: sensor unit 25: firearm connecting unit
26: image display unit 27: optical lens device (aiming lens)
28: main control unit 29: menu selecting switch
30: ammunition 31: fuse receiving unit
32: high explosive gun powder and fragment body unit

MODE FOR THE INVENTION

The firearm having dual barrels of the present invention will be described with reference to the drawings attached.

Figure 2:
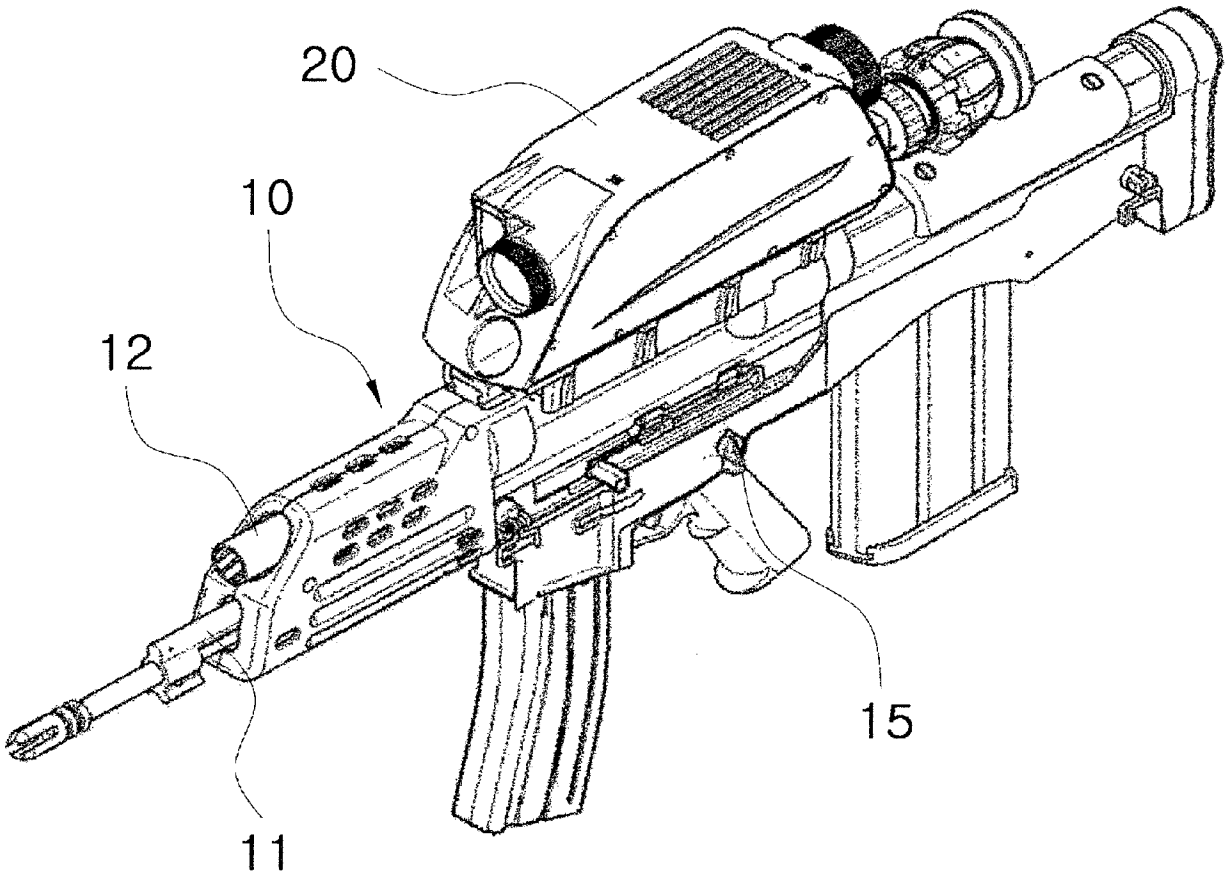
FIG. 2 is a perspective view from left of the firearm having dual barrels according to the present invention.
Figure 3:
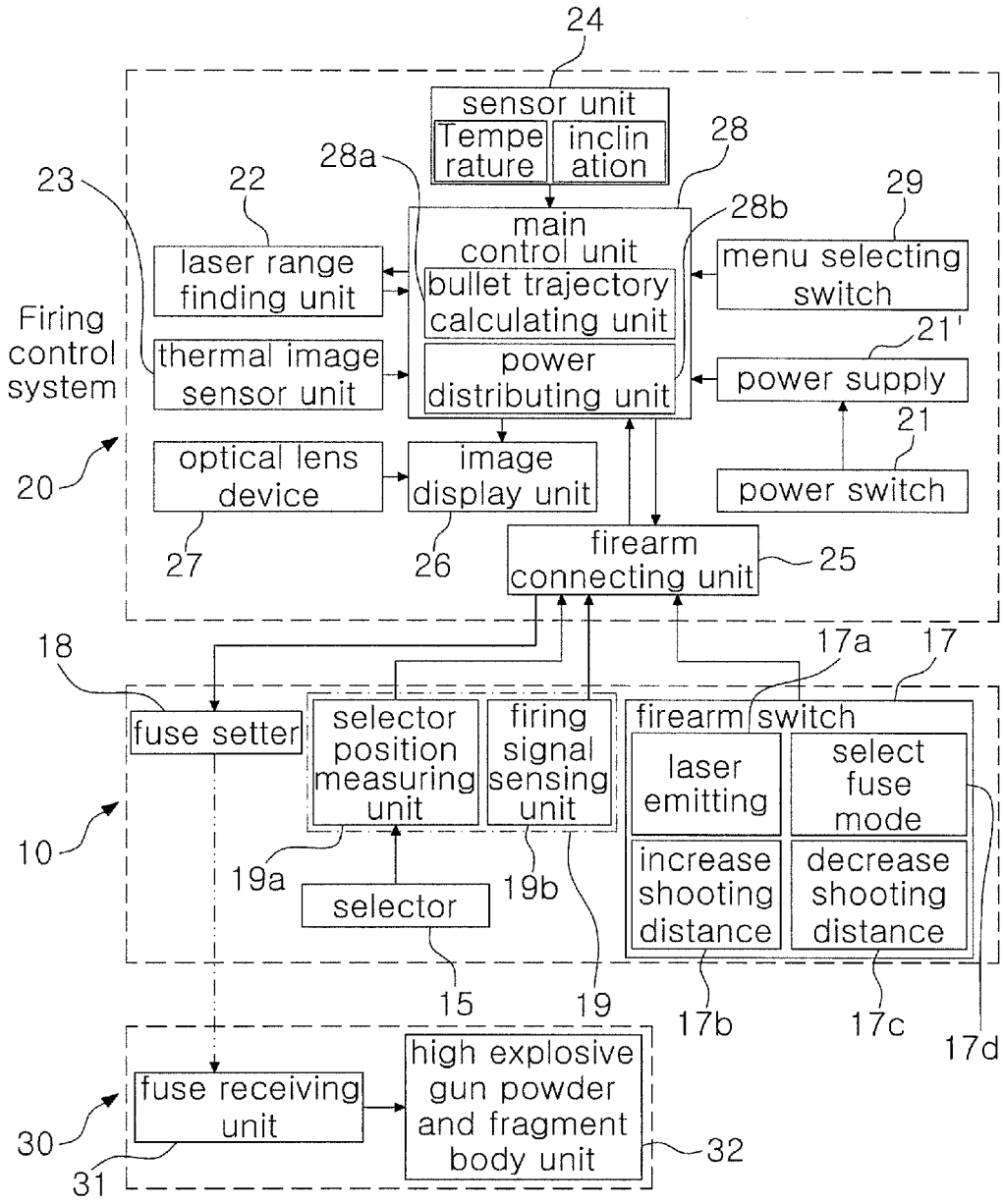
FIG. 3 is a block diagram showing the interface relation of the firearm having dual barrels according to the present invention.
Figure 4:
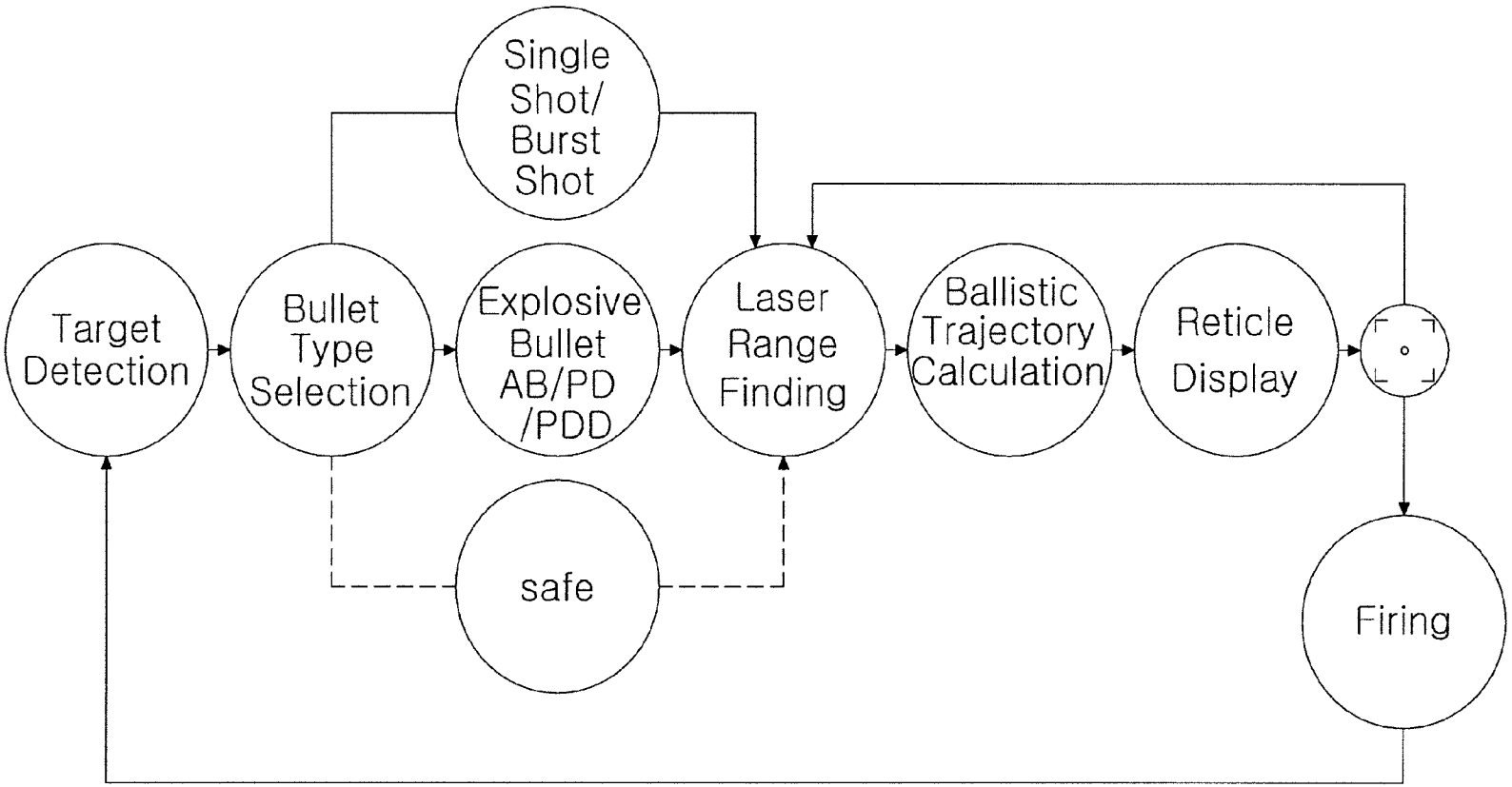
FIG. 4 is a flow chart of the control of combat mode for the firearm having dual barrels according to the present invention.

FIG. 1 is a perspective view from right of the firearm having dual barrels according to the present invention, FIG. 2 is a perspective view from left of the firearm having dual barrels according to the present invention, FIG. 3 is a block diagram showing the interface relation of the firearm having dual barrels according to the present invention, and FIG. 4 is a flow chart of the control of combat mode for the firearm having dual barrels according to the present invention.

The firearm having dual barrels according to the present invention comprises a firearm body 10 which is equipped with a small caliber barrel 11 which fires small caliber regular bullet, and a large caliber barrel 12 which fires large caliber explosive bullet, can selectively fire a regular bullet or an explosive bullet through one trigger 13; a selector 15 installed on one side of the firearm body 10 to select the type of bullet and the mode of firing; a fire control system 20 installed on the firearm body 10 to enable aiming the target at daytime and night and to provide a firing data for explosive bullet by measuring the distance to the target; a firearm switch unit 17 installed on the firearm body 10 to transmit the information on the firing of the bullet which is additionally input by the user to the fire control system 20; a fuse setter 18 installed on the large caliber barrel 12 of the firearm body 10 to transmit the control signal of the fire control system 20 to the fuse of the explosive bullet which is inserted into the large caliber barrel 12; and a sensor device unit 19 installed on the firearm body 10 to transmit the position of the selector 15 and sensed firing signal to the fire control system 20.

In the firearm, the selector 15 selects as the state value among an explosive bullet, single shot, burst shot and safe by the rotation of the selector. So, when a user needs to fire an explosive bullet, the explosive bullet mode can be selected, and when the user needs to fire a regular bullet through the small caliber barrel, the mode of single shot or burst shot can be selected, and when firing is not needed, the safe mode can be selected.

Additionally, the fire control system 20 is equipped with power switch 21 which is connected to the power supply 21 and introduces power to the daytime mode or night mode, a firearm connecting unit 25 for the interface with the firearm body 10, a laser range finding unit 22 for measuring the distance to the target, a thermal image sensor unit 23 for detecting thermal image in the night mode, an image display unit 26 which displays on the optical lens device 27 the target distance acquired by the laser range finding unit 22 and the thermal image detected by the thermal image sensor unit 23, a power distribution unit 28*a* which supplies power to each units, and ballistic trajectory calculation unit 28*b* which calculates the bullet trajectory according to the target distance, and comprises a main control unit 28 which controls each device according to the signal of the firearm body 10 transmitted by the firearm connecting unit 25 and transmits the control signal of the fuse of the explosive bullet to the fuse setter 18, and a menu selecting switch 29 which enables selecting of the menus for controlling internal devices.

Also, the fire control system 20 comprises a sensor unit 24 comprising an inclination sensor detecting the inclination of the firearm body 10 and a temperature sensor, and the main control unit 28 changes the reticle displayed at the optical lens device 27 according to the inclination of the firearm body 10 and the temperature information.

And, the firearm switch unit 17 comprises a laser emitting switch 17*a* installed on the fire control system 20 for controlling the laser range finding unit 21, a range increment switch 17*b* and range decrement switch 17*c* for controlling the range to the value determined according to the detected range, and a fuse mode selection switch 17*d* for determining the mode of explosion of the explosive bullet.

Also, the fuse setter 18 transfers the energy required for the explosive operation of the fuse receiving unit of the explosive bullet in the way of non-contacting magnetic induction, and transmits the range information determined at the fire control system 20 to the fuse receiving unit 31. At this time, the range information should be input before the primer of the explosive bullet is fired by the firing pin in the large caliber barrel 12.

And, the sensor device unit 19 comprises a selector position measuring unit 19*a* for detecting the position of the selector 15 and a firing signal sensing unit 19*b* which generates a firing signal according to the movement of the trigger 13.

Accordingly, information on the position of the selector 15 and the firing signal detected at the sensor device unit 19 is transmitted to the main control unit 28 through the firearm connecting unit 25 of the fire control system 20.

The firearm having dual barrels constructed according to the present invention enables controlling of the fire control system and the ammunition through the interfaces between the body of firearm and the fire control system, between the fire control system and the ammunition, and between the ammunition and the body of the firearm.

When introducing power to the fire control system 20, the power switch 21 is set to the needed operation mode according to the environment among the daytime or night operation mode. And, when a target is detected through the optical lens device 27 of the fire control system 20, the selector 15 is adjusted to a single shot or burst shot to fire a regular bullet depending on the type of the target and operation mission. Then, the target is placed on the laser aiming point mounted on the optical lens device 27 of the fire control system 20, and the laser emitting switch 19*a* installed on the firearm body 10 is pressed. Then, the distance to the target is measured by the laser range finding unit 22 of the fire control system 20.

When measuring the distance to the target is completed, the aiming point which is calculated at the main control unit 28 of the fire control system 20 is displayed in the optical lens device 27 of the fire control system 20. At this point, the target can be attacked by pulling the trigger 13 while matching the target to the aiming point.

Meanwhile, when an explosive bullet with large caliber is to be fired, the selector 15 is adjusted to explosive bullet, and the mode of explosion is selected among "point detonation", "point delayed detonation" and "air bursting" by using the fuse mode selection switch 17*d* of the firearm switch 17 depending on the type of the target and operation mission. Then, the distance to the target is measured by pressing the laser emitting switch 17*a* so that the aiming point is displayed in the optical lens device 27. At this time, power is introduced through the fuse setter 18 of the firearm body 10 so as to activate the fuse of the ammunition 30 which is an explosive bullet, and information on the fuse mode and range are introduced to the fuse of the ammunition 30 according to the bullet trajectory calculated by the ballistic trajectory calculating unit 28*b* of the main control unit 28.

If the range is needed to be increased or decreased, it can be increased or decreased by adjusting the range increment switch 17*b* or range decrement switch 17*c* of the firearm switch 17. The aiming point which enables the bullet hit the target is also re-calculated in accordance with the changed range when the range is increased or decreased. At this state, the target can be attacked by pulling the trigger 13 while matching the target to the aiming point.

The signal-associated construction for firing of the firearm having dual barrels according to the present invention will now be described below.

Power is introduced to the fire control system 20 through the power supply 21 by locating the power switch 21 of the fire control system 20 at a night mode or daytime mode position. At this time, the power distribution unit 28*a* installed in the main control unit 28 distributes power of the power supply 21 to each element of the device. Especially, when the power switch 21 is at a night time operation mode, thermal image of the target and surroundings are acquired by the thermal image sensor unit 23, and displayed on the optical lens device 27 through the image display unit 26. Then by manipulating the menu selecting switch 29 of the fire control system 20, the operation mode of the fire control system 20 is set.

In order to select the type of bullets and firing mode, the selector 15 of the firearm body 10 is adjusted to one position among 'explosive bullet', 'single shot', 'burst shot' and 'safe', then the type of bullets and firing mode are recognized by the selector position measuring unit 19*a* of the sensor device unit 19 installed in the firearm body 10, the recognized information on the type of bullets and firing mode are transmitted to the main control unit 28 through the firearm connecting unit 25. Accordingly, the selected type of bullets and firing mode are displayed on the optical lens device 27 through the image display unit 26 connected to the main control unit 28.

When the selector 15 is positioned at 'explosive bullet', the target is matched to the laser aiming point displayed on the optical lens device 27, and the laser emitting switch 19*a* is pressed. Then, a laser emitting signal is input to the main control unit 28 through the firearm connecting unit 25, and the firearm connecting unit 25 acquires target distance through the laser range finding unit 22. At this point, the laser aiming point etched at the optical lens device 27 is used as a laser aiming point at daytime, and a laser aiming point displayed on the optical lens device 27 by the image display unit 26 is used as a laser aiming point at night.

The target distance acquired by the above process is displayed on the optical lens device 27 through the image display unit 26, and if the target distance is needed to be changed, the user can press the range increment switch 19*b* or range decrement switch 19*c* of the firearm switch 19. Then, the signal of increasing or decreasing range for the changed target distance is input to the main control unit 28 through the firearm connecting unit 25, and the range which is changed through the calculation of bullet trajectory by the main control unit 28 is displayed on the optical lens device 27 through the image display unit 26.

Meanwhile, when the switch 19*a* and the range increment switch 19*b* or the range decrement switch 19*c* is pressed, the fire control system 20 transfers electric energy to the fuse setter 18 of the firearm body 10 through the firearm connecting unit 25, and the fuse setter 18 transfers the energy required for the explosive operation of the fuse receiving unit 31 ammunition 30 in the way of non-contacting magnetic induction. At this time, the range information transmitted to the fuse receiving unit 31 is determined based on the range calculated at the main control unit 28, and the range information transmitted to the fuse receiving unit 31 also varies according to the range changed by the range increment switch 19*b* and range decrement switch 19*c*. Then, the ballistic trajectory calculating unit 28*b* installed in the main control unit 28 calculates a bullet trajectory to the target by using the acquired range information, and the temperature and inclination information acquired by the sensor unit 24, and the reticle determined by the calculated bullet trajectory is displayed on the optical lens device 27 through the image display unit 26.

At this time, the fuse mode which determines the mode of explosion of the ammunition 30 changes as the fuse mode selection switch 19*d* of the firearm switch 19 is pressed. In other words, the fuse mode is sequentially changed among 'point detonation', 'point delayed detonation' and 'air bursting' as the fuse mode selection switch 19*d* is pressed. When appropriate fuse mode is selected by the user, the fuse mode selection signal is input to the main control unit 28 through the firearm connecting unit 25, and the position of the reticle is changed by the ballistic trajectory calculation according to the input fuse mode selection signal.

When the reticle is determined by the above process, an explosive bullet is fired by aligning the reticle to the target and pulling the trigger 13. By pulling the trigger 13, the firing signal sensing unit 19*b* of the sensor device unit 19 recognizes the firing signal, and the firing signal is transmitted to the main control unit 28 through the firearm connecting unit 25. The main control unit 28 accordingly transmits the range information to the fuse receiving unit 31 through the firearm connecting unit 25 and fuse setter 18. At this time, it is obvious that the range information should be input before the primer of the ammunition 30 is fired by the firing pin in the large caliber barrel 12.

The warhead of the explosive bullet separated from the barrel of the firearm body 10 move forwards rotating, when the warhead reaches the target, the fuse receiving unit 31 sends an explosion signal to the high explosive gun powder and the fragment body unit 32, thereby making the ammunition 30 explode.

When the selector 15 is positioned at the 'single shot' or 'burst shot', the reticle corresponding to a predetermined range is displayed on the optical lens device 27 so that regular bullet can be fired through the small caliber barrel 11. At this time, the position of the reticle is changed according to the information of temperature and inclination acquired by the temperature sensor and inclination sensor of the sensor unit 24.

The structure regarding the interface of the firearm having dual barrels can also be applied to the design of a crew-served weapon as well as an individual weapon.

While the invention has been described with reference to preferable embodiments, the scope of the present invention is not limited to the specific examples and the examples can be modified within the scope of the claims of the present invention by those skilled in the art.

The invention claimed is:

1. A firearm having dual barrels, comprising:

a firearm body equipped with a small caliber barrel configured to fire small caliber bullets and a large caliber barrel configured to fire explosive bullets, the small caliber bullet or explosive bullet being selectively fired through a trigger;

a selector installed on one side of the firearm body to select the type of bullet and the mode of firing;

a fire control system installed on the firearm body and configured to aim the target both at day in a day mode and at night in a night mode and configured to provide firing data for the explosive bullet by measuring the distance to a target;

a firearm switch unit installed on the firearm body and configured to transmit the information on the firing of a bullet which is input by a user to the fire control system;

a fuse setter installed on the large caliber barrel of the firearm body to transmit a control signal of the fire control system to the fuse of the explosive bullet; and a sensor device unit installed on the firearm body to transmit the position of the selector and the sensed firing signal to the fire control system;

wherein the fire control system comprises:

a power switch which is connected to a power supply which introduces power during the daytime mode or night mode;

a firearm connecting unit for interfacing with the firearm body;

a laser range finding unit for measuring the distance to the target;

a thermal image sensor unit for detecting a thermal image in the night mode;

an image display unit which displays on an optical lens device the target distance acquired by the laser range finding unit and the thermal image detected by the thermal image sensor unit;

a power distribution unit which supplies power to each these units; and a ballistic trajectory calculation unit which calculates the bullet trajectory according to the target distance, and which comprises a main control unit for controlling the firearm according to a signal transmitted by the firearm connecting unit and the control signal from the fuse of the explosive bullet to the fuse setter, and which comprises a menu selecting switch for selecting control menus.

2. The firearm having dual barrels of claim 1, wherein the selector selects among an explosive bullet, single shot, burst shot, and safe.

3. The firearm having dual barrels of claim 1, wherein the fire control system comprises a sensor unit comprising an inclination sensor for detecting the inclination of the firearm body and a temperature sensor, wherein the main control unit changes the reticle displayed at the optical lens device according to the inclination of the firearm body and the temperature information.

4. The firearm having dual barrels of claim 1, wherein the firearm switch unit comprises:

a laser emitting switch installed on the fire control system for controlling the laser range finding unit;

a range increment switch;

a range decrement switch for controlling the range to the value determined according to the detected range; and a fuse mode selection switch for determining the mode of explosion of the explosive bullet.

5. The firearm having dual barrels of claim 1, wherein the fuse setter transfers the energy required for the explosive operation of the fuse receiving unit of the explosive bullet by non-contacting magnetic induction and transmits the range information determined at the fire control system to the fuse receiving unit.

6. The firearm having dual barrels of claim 5, wherein the range information is input before a primer of the explosive bullet is fired by a firing pin in the large caliber barrel.

7. The firearm having dual barrels of claim 1, wherein the sensor device unit comprises a selector position measuring unit for detecting the position of the selector and a firing signal sensing unit which generates a firing signal according to the movement of the trigger.

* * * * *